US006053826A

United States Patent [19]

Koole

[11] Patent Number: 6,053,826

[45] Date of Patent: Apr. 25, 2000

[54] CONNECTING SYSTEM FOR THE DUNK RING OF A BASKETBALL-STAND HAVING A BACK-BOARD MADE OF GLASS

[75] Inventor: Peter Marinus Koole, Kloetinge, Netherlands

[73] Assignee: Schelde International B.V., Netherlands

[21] Appl. No.: 09/109,281

[22] Filed: Jun. 30, 1998

[51] Int. Cl.[7] ..... A63B 63/08

[52] U.S. Cl. ..... 473/485; 473/481

[58] Field of Search ..... 473/479, 481, 473/485, 486, 483, 484

[56] References Cited

U.S. PATENT DOCUMENTS 5,037,092 8/1991 Blackburn ..... 473/481

*Primary Examiner*—Jeanette Chapman
*Assistant Examiner*—M. Chambers
*Attorney, Agent, or Firm*—Brooks & Kushman P.C.

[57] ABSTRACT

A system for connecting the dunk ring of a basketball-stand to a beam of the stand, the back-board being of glass and being surrounded and supported by a frame which is connected to the beam.

A spacer block is interposed in the connection of the dunk ring attachment plate and the attachment element of the beam. The spacer block allows for a sufficient spacing, which, at least, corresponds to the thickness of the back-board. The back-board is then provided with a cut-away which is open towards the lower edge and which, in its mounted position, straddles the spacer block.

In this way forces from the ring to the beam are guided directly, without in any way imparting the back-board.

The spacer block may be realized in such a way that it is fixed to the lower element of the frame which surrounds the glass back-board.

4 Claims, 5 Drawing Sheets

CONNECTING SYSTEM FOR THE DUNK RING OF A BASKETBALL-STAND HAVING A BACK-BOARD MADE OF GLASS

BACKGROUND

STATE OF THE ART

The invention relates to a system for connecting the dunk ring of a basketball-stand to a beam of the stand, the back-board being of glass and being surrounded and supported by a frame which is connected to said beam.

STATE OF THE ART

Back-boards of basketball-stands may be manufactured in various materials such as plywood, fiberboard, non-transparant plastics, transparant plastics such as acrylic resin or hardened glass. Glass has the advantage of providing a uniform rebound. With other materials the value of rebound must be adjusted to the desired value by an appropriate choice of the thickness, but inherent properties of the materials may make this difficult and for example under tension the rebound will change. A back-board made of glass has the additional advantage of being transparent, which is favorable for the public standing behind the basketball-stand.

Up to now the dunk ring, which is usually integral with an attachment plate, is connected, by means of bolts, to an attachment element at the end of the beam of the stand. The bolts used for this connection extend through holes in the back-board, resulting in the back-board being clampingly sandwiched between the two attachment plates. While this does no harm for other materials, it does in case of glass back-boards. The harm is that when players pull the dunk ring down or even hang temporarily on the ring, a deformation occurs which also affects the back-board. This may result in breaking of the back-board.

THE OBJECTS OF THE INVENTION

The main object of the invention is to provide a solution for this problem and to propose a system for connecting the dunk ring to the beam of the stand while keeping the glass back-board free of any tension which occurs in this connection.

A secondary object of the invention is to realize this in such a manner that the manufacturing process will not become too difficult or would result in too high a price for the stand.

SUMMARY OF THE INVENTION

The invention provides for a spacer block being interposed in the connection of the dunk ring attachment plate and the attachment element of the beam. The spacer block allows for a sufficient spacing, which at least corresponds to the thickness of the back-board. The back-board is then provided with a cut-out which is open towards the lower edge and which, in its mounted position, straddles the spacer block.

In this way forces from the ring to the beam are guided directly, without in any way imparting the back-board.

The spacer block may be realised in such a way that it is affixed to a lower element of the frame which surrounds the glass back-board.

SHORT DESCRIPTION OF THE DRAWINGS

DESCRIPTION OF THE PREFERRED EMBODIMENT

Figure 1:
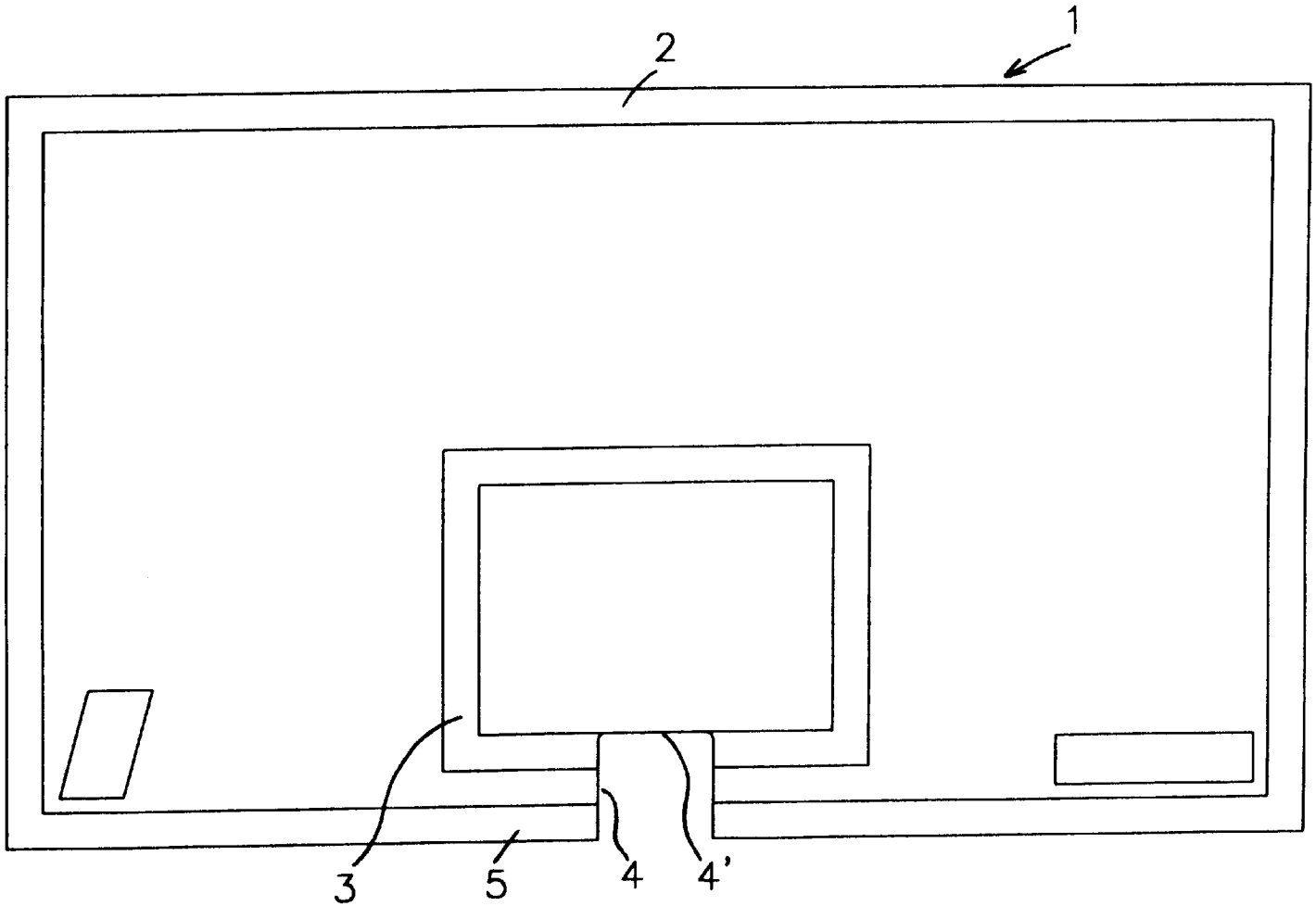
FIG. 1 is an elevational view of the glass back-board proper according to the invention.

FIG. 1 shows a basketball back-board 1. It has a circumferential marking 2 and a rectangular marking 3 for the dunk ring to be mounted in front of the back-board.

Back-board 1 is provided with a cut-out 4 of a substantially rectangular shape, which is open towards the lower edge 5 of the board. Its upper end 4' lies at the same level as the inside of dunk ring marking 3 in view of the dunk ring support to be described and in view of the fact that the inside of marking 3 is to lie flush with the top of the dunk ring.

Figure 2:
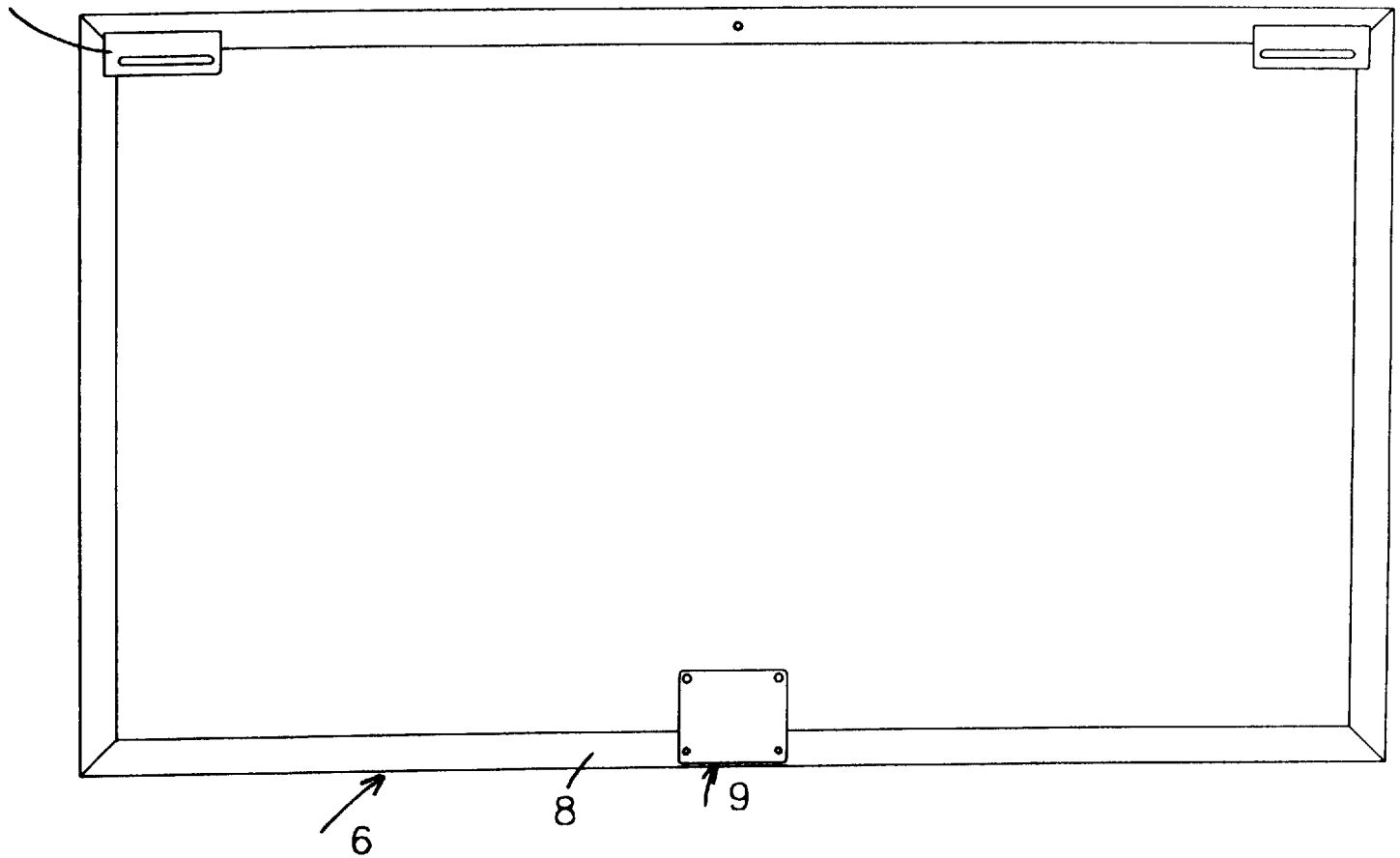
FIG. 2 is a rear elevational view of the frame, composed of box section elements, which, after adding an appropriate angle section, will surround and support the back-board.
Figure 3:
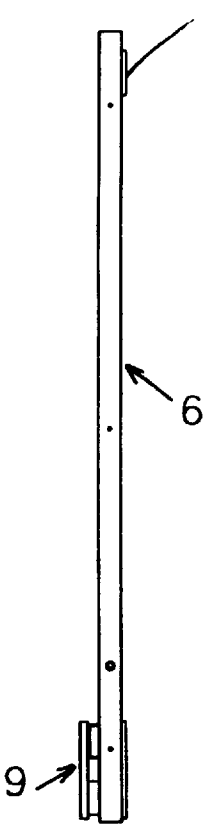
FIG. 3 is an elevational view from the left against the frame shown in FIG. 2.

FIG. 2 represents, in an elevational view from the rear, the box section frame 6 which constitutes the main element of the frame which surrounds the back-board. Welded near two upper corners are fixation plates such as 7 which, as is known in the art, serve to attach shore means, not represented, the function of which is to connect the frame to the beam of the basketball-stand.

Figure 2A:
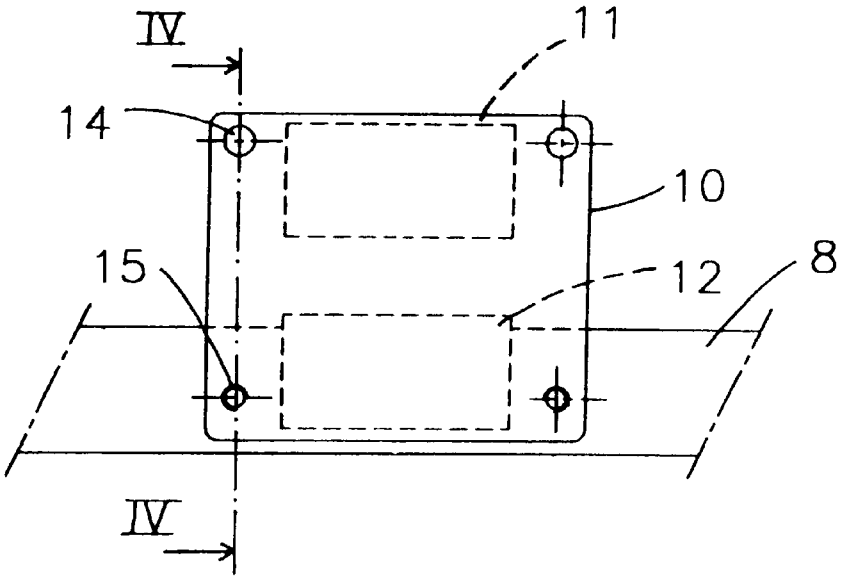
FIG. 2A is a detail of FIG. 2 showing the spacer block at an enlarged scale.

In the middle of lower frame element 8 a spacer block is formed, indicated as a whole by 9, and shown on a larger scale and in more detail in FIG. 2A.

Figure 4:
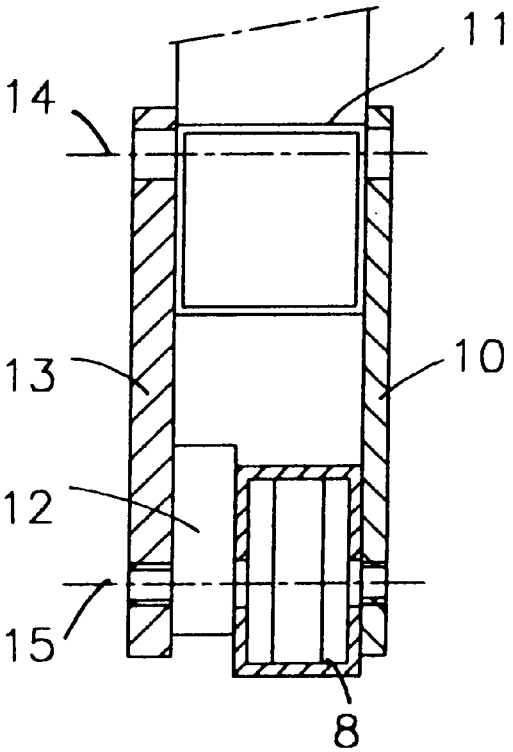
FIG. 4 shows the spacer block as a vertical cross-sectional view according to the section line IV—IV in FIG. 2A.

FIG. 4 is a vertical cross-section on a still further enlarged scale of spacer block 9 at the location indicated by section lines IV—IV in FIG. 2A.

The rear spacer block plate 10 is welded against the rear of the box profile of lower frame element 8. Thereupon more upwardly a piece of box section 11, having a length which is somewhat shorter than the length (horizontal dimension) of plate 9, as appears from FIG. 2A, is welded to plate 10, at the same side thereof as element 8. Then a filler element 12 is welded against element 8. Filler element 12 may have the same horizontal dimension as box section 11, as appears again from FIG. 2A. Finally against the front of box profile 11 and filler element 12 a front spacer block plate 13 is welded. The dimensions of front plate 13 are preferably equal to those of rear plate 10.

After completion of the welding of spacer block 9 thrugoing upper bore holes such as 14 near each of the upper corners, and a pair of throughgoing bore holes 15 near each of the lower corners of spacer block are made, the latter being completed with threads in each of plates 10 and 13.

Figure 5:
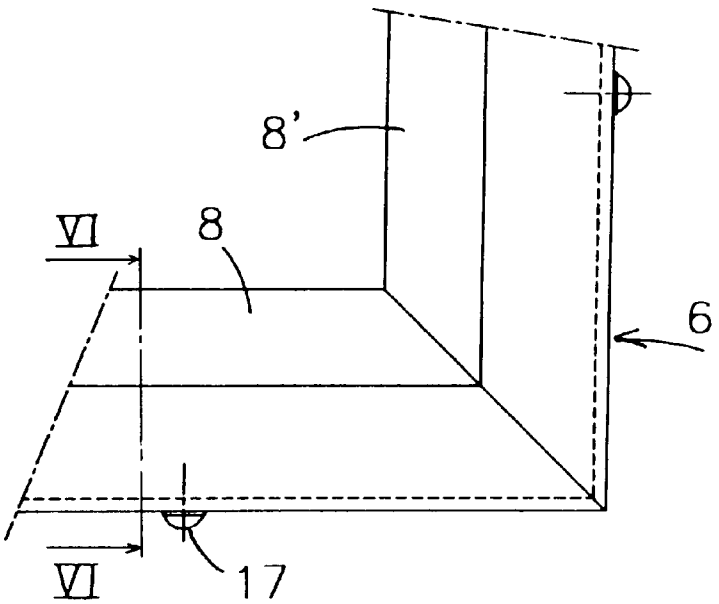
FIG. 5 shows on an enlarged scale as compared with FIG. 2, one corner of the frame which is to surround the back-board, after completion with the angle section elements, and in this case seen from the front.
Figure 6:
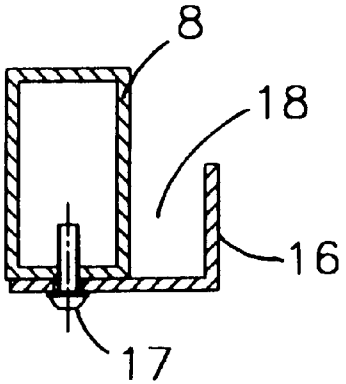
FIG. 6 is a cross-sectional view according to section lines VI—VI in FIG. 5.

In order for the box section frame 6 to be able to support back-board 1 a set of angle section elements is attached to it. FIG. 5 shows a corner part of frame 6, with lower frame element 8 and one vertical frame element 8'. From FIG. 6 it appears that an angle section element 16, having one leg which is longer than the width of frame box section 8, is attached against the bottom of the latter, preferably by bolts such as 17. This is done all around the frame. It creates a space 18 which serves to receive the back-board.

Figure 7:
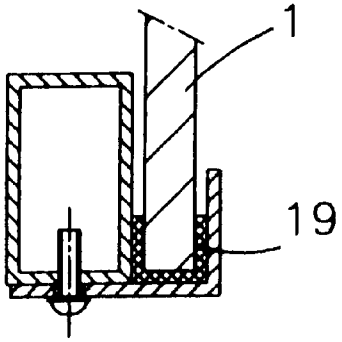
FIG. 7 shows the same as FIG. 6 but after this frame element having been mounted around the back-board.

As is shown in FIG. 7 this is done while incorporating a U-shaped section 19, made of some resilient material such as rubber, all around the circumference of back-board 1. Mounting may be done either by laying the back-board 1 with resilient section 19 around its circumference, in a horizontal position on box section frame 6 and then successively fixing the four angle section elements such as 16 all around or, for example, by first fixing the angle section elements such as 16 along three of the four sides of box section frame 6, then introducing back-board 1 with resilient section 19, and finally mounting and fixing the fourth angle section element.

Figure 8:
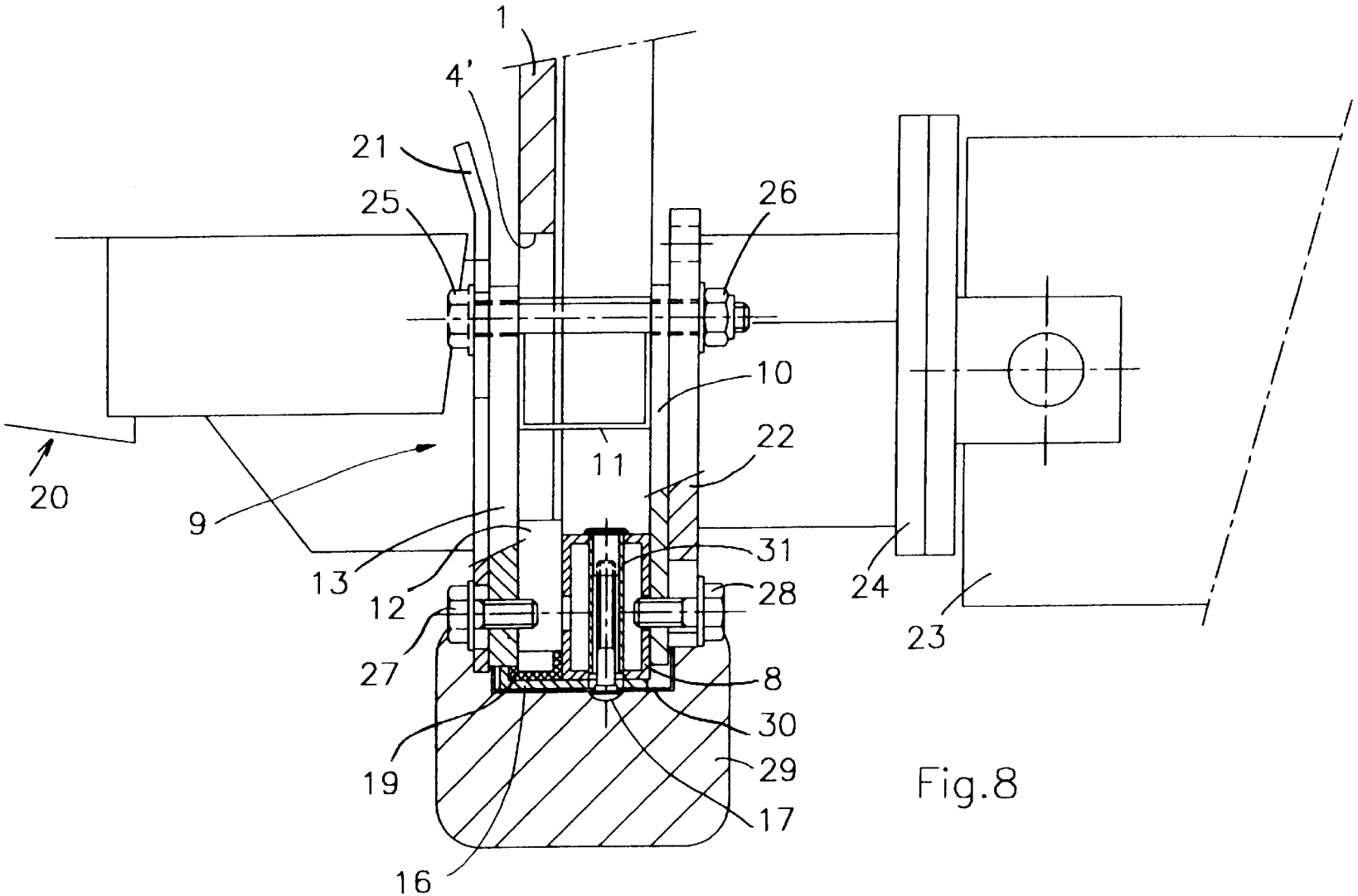
FIG. 8 shows, partially as a vertical elevational view, partly as a sectional view at the location of the fixation bolts, the system according to this invention in the fully mounted condition of the back-board and the dunk ring at the end of the beam of the basketball-stand.

FIG. 8 shows the structure in its entirety in mounted condition. In FIG. 8 one will recognize the picture of FIG. 4 representing the vertical section of spacer block 9: the front and rear spacer block plates 13 and 10, box section spacer element 11, the lower box section element 8 of the frame and filler piece 12. Also visible, of course, are angle section elements 16, resilient section 19 and basketball back-board 1. Furthermore one will recognize the upper end 4' of the cut-out 4 in back-board 1 (compare FIG. 1). Dunk ring unit 20 is carried, in usual manner, by a vertical ring attachment plate 21 which is provided with bore holes, the locations of which correspond with the four bore holes in spacer block 9 which are visible in FIGS. 2A and 4, two of which bear reference numerals 14 and 15.

An attachment plate 22 is carried at the end of the usual beam 23 of the basketball-stand, by means of also usual intermediate structure 24 which doesn't belong to the invention and, therefore, which needs no further clarification here. Also attachment plate 22 is provided with four bore holes at locations corresponding with the bore holes such as 14 and 15 in spacer block 9 as well as with those in dunk ring attachment plate 21.

The back-board, mounted within its frame inclusive of the spacer block 9, is placed between attachment plate 21 and attachment plate 22, in such a position that all corresponding bore holes are aligned, and that threaded bolts such as 25 can be inserted through the upper pair of holes 14, projecting from the rear of attachment plate 22 where nuts such as 26 can be threaded on. Two shorter bolts such as 27 are put through the holes in attachment plate 21 and threaded into the threaded holes 15 in front plate 13 of spacer block 9. In similar manner a pair of shorter bolts 28 is put through the lower holes in attachment plate 22 and threaded into the threaded bore holes 15 in rear plate 10 of the spacer block. Cut-out 4 will straddle spacer block 9.

In FIG. 8 it is visible that the upstanding legs of resilient section 19 are somewhat shorter than those depicted in FIG. 7 which represents the normal shape. This shows that at the location of spacer block 9, over the width thereof, cut-outs have to be made in resilient section 19 in order to accomodate front plate 13 and filler piece 12 of spacer block 9.

Finally, FIG. 8 depicts the usual padding 29, which has a cavity cladded with a U-section 30, and which is attached to the lower part of the entire back-board structure as described. Also shown is that bolts 17 are completed by tubular nuts 31—known as patent nuts—which have the advantage over traditional hexagonal nuts that their heads are flat and project only over a minor height above the box profile of lower frame element 8.

What is claimed is:

1. In a system for supporting a back-board and dunk ring on the end of a beam in a basketball stand, the combination consisting of:

a spacer block interposed between and fastened to an attachment plate on the dunk ring and an attachment plate on the beam;

a glass back-board peripherally surrounded and supported in a frame;

said spacer block having a gap therein for receiving a portion of said frame and supporting the frame and in turn the back-board on the beam; and said back-board having a cut-out opening through a marginal edge thereof for straddling the spacer block when the frame and back-board are mounted thereon as aforesaid.

2. A system as claimed in claim 1, wherein said spacer block is fixed to a lower peripheral edge of the frame surrounding the back-board.

3. In a system for connecting the dunk ring of a basketball stand to a beam of the stand and having a glass back-board peripherally surrounded and supported by a frame, the invention consisting of:

a spacer block having front and rear plates;

spacing elements attached to and disposed between said spacer block plates to space them apart creating a gap therebetween;

a dunk ring having a dunk ring attachment plate connected to the front plate of the spacer block;

a beam of the stand having a beam attachment plate connected to the rear plate of the spacer block; and said frame having a lower marginal edge disposed in said gap between the spacer block plates and secured thereto with a cut-out in a lower peripheral edge of the black-board straddling said elements.

4. The system as in claim 3 wherein said front and rear spacer block plates overlie and oppose surfaces of said frame and are secured thereto for supporting the frame and in turn the back-board on the beam of the basketball stand.

* * * * *